United States Patent [19]

Date et al.

[11] 4,105,878

[45] Aug. 8, 1978

[54] VACUUM INTERRUPTER AND DISCONNECT COMBINATION

[75] Inventors: Kazuo H. Date; Ronald A. Wainio, both of South Milwaukee, Wis.

[73] Assignee: McGraw-Edison Company, Elgin, Ill.

[21] Appl. No.: 759,656

[22] Filed: Jan. 17, 1977

[51] Int. Cl.[2] ..... H01H 33/12; H01H 33/66

[52] U.S. Cl. ..... 200/146 R; 200/144 B

[58] Field of Search ..... 200/144 B, 146 R

[56] References Cited

U.S. PATENT DOCUMENTS 3,824,359 7/1974 Date ..... 200/146 R

*Primary Examiner*—Robert S. Macon

*Attorney, Agent, or Firm*—Thomas E. McDonald; Jon Carl Gealow; Ronald J. LaPorte

[57] ABSTRACT

A compact combination vacuum interrupter and visible break disconnect switch, in which the interrupter is electrically connected in series with the disconnect. The interrupter is manually closed, and can be tripped manually or automatically on overcurrent or undervoltage line conditions by a quick make, quick break, trip-free operating mechanism.

The disconnect is manually opened or closed by a separate operating mechanism, which is mechanically interlocked with the interrupter operating mechanism so that the disconnect cannot be opened when the interrupter is closed, or the interrupter cannot be closed when the disconnect is open. The disconnect can be padlocked in its open position.

The interrupter is mounted integral with the movable contact of the disconnect on a pivotable, insulating support member of the disconnect, with the movable contact rod of the interrupter pivotably connected to the interrupter operating mechanism. When the interrupter is in its open position, the pivotal axis of the interrupter movable contact rod coincides with the pivotal axis of the disconnect insulating support member, so that, when the disconnect is opened, the interrupter is pivoted about the same axis as the disconnect movable contact while the interrupter contacts are maintained at their fully open position.

12 Claims, 13 Drawing Figures

FIG. 5
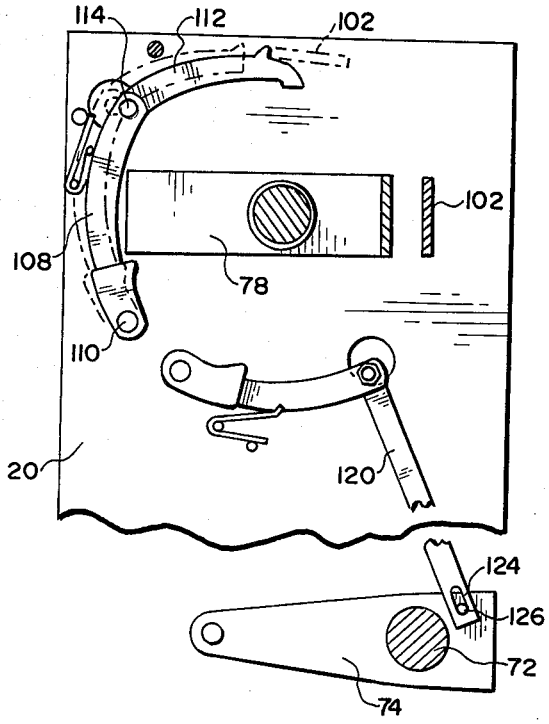
FIG. 6
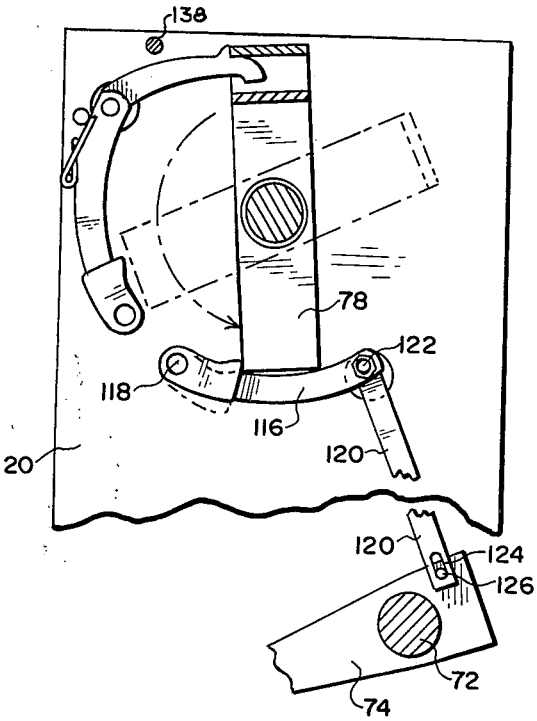
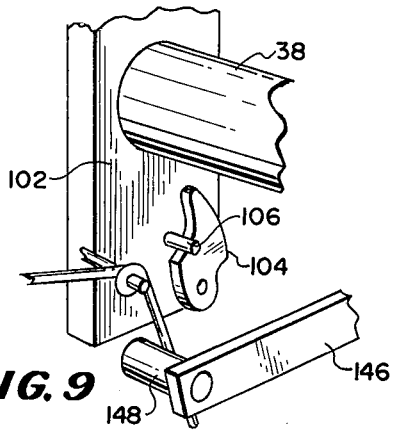
FIG. 9
FIG. 7
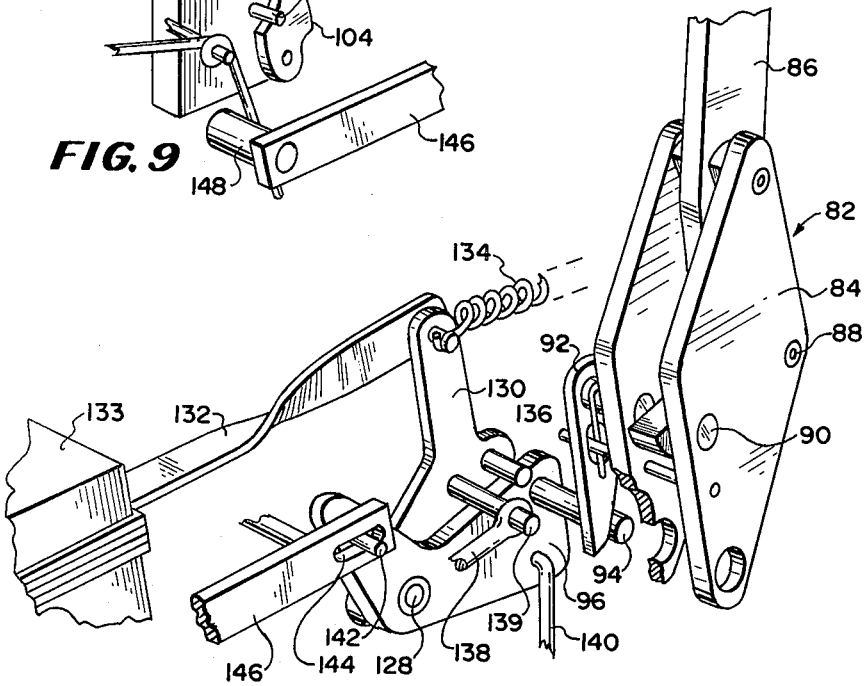
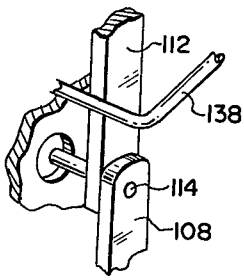
FIG. 8

VACUUM INTERRUPTER AND DISCONNECT COMBINATION

BACKGROUND OF THE INVENTION

1. Field of the Invention

This invention relates generally to the field of electric power circuit interrupter devices, and in particular to a combination vacuum interrupter and visible break disconnect switch.

2. Prior Art

In known combination vacuum interrupter and visible break disconnect switches, such as the vacuum load-break switch disclosed in U.S. Pat. No. 3,824,359 issued on July 16, 1970 to Kazuo H. Date, a vacuum interrupter, connected electrically in parallel with a visible break disconnect switch, has a quick break operating mechanism actuated by the disconnect switch, to trip the vacuum interrupter upon opening of the disconnect switch and thus interrupts the load current then flowing solely through the vacuum interrupter.

In such a compact combination interrupter and disconnect switch, it would be very advantageous if the vacuum interrupter were electrically connected in series with the disconnect and could be operated independently of the disconnect only when the disconnect were closed, and the disconnect could be operated independently of the vacuum interrupter only when the interrupter were open. In such an arrangement, the vacuum interrupter could be used to automatically interrupt fault currents or to trip under low voltage conditions. A combination switch of this type would be particularly advantageous in industries such as the mining industry, in which undervoltage protection and padlockable, visible break disconnects are generally required, and compact sized equipment is highly desirable because of space limitations.

OBJECTS AND SUMMARY OF THE INVENTION

Therefore, it is a primary object of the invention to provide a compact combination of a vacuum interrupter connected electrically in series with a visible break disconnect switch, having a quick make, quick break operating mechanism for the vacuum interrupter, a separate manual operating mechanism for the disconnect switch, and a mechanical interlock which prevents opening the disconnect switch when the vacuum interrupter is closed, and closing the vacuum interrupter when the disconnect is open.

It is a further object of the invention to provide means for automatically tripping the vacuum interrupter upon occurrence of an overcurrent or fault condition to interrupt the fault current flowing therethrough. Also, it is a related object of the invention that the vacuum interrupter operating mechanism be trip-free, so that the interrupter can be quickly tripped by the overcurrent tripping means when the interrupter is manually closed into a line fault, even if the manual operating handle is held in its closed position.

A still further object of the invention is to provide means for automatically tripping the vacuum interrupter upon loss of line voltage or upon occurrence of a low line voltage condition. Also it is a related object of the invention to provide means for preventing reclosing the vacuum interrupter during a low line voltage condition.

The disconnect switch includes a fixed contact, electrically connected to one side of the power line and mounted on a support insulator, and a movable contact mounted at the free end of a pivotable support member made of electrical insulating material. This insulating support member is pivotable about an axis disposed at one end of another support insulator, and is connected to a crank arm of the disconnect operating shaft by an insulating connecting link pivotably connected to a medial portion of the pivotable support member. The fixed and movable disconnect switch contacts may be engaged or disengaged by rotation of a manual operating handle fastened to one end of the disconnect operating shaft. A common disconnect operating shaft with multiple crank arms may be used to gang operate several individual disconnect switches as a multiple pole switch.

The vacuum interrupter is mounted on the pivotable insulating support member of the disconnect switch, with its fixed contact rod adjacent and connected to the disconnect switch movable contact, and its movable contact rod electrically connected to the other side of the power line. The movable contact rod of the vacuum interrupter is pivotably connected to one end of a bell crank disposed on the support insulator carrying the pivot axis of the insulating support member of the disconnect switch. The other end of this bell crank is pivotally connected to a crank arm of the vacuum interrupter operating shaft. When several of these combination switches are gang operated as a multi-pole switch, a common interrupter operating shaft with multiple crank arms, corresponding to the common disconnect operating shaft, is used.

This vacuum interrupter operating shaft is a portion of a quick make, quick break, trip free interrupter operating mechanism which also includes an interrupter manual operating shaft and handle, rotatable between a closed and an open or tripped position.

The disconnect and interrupter manual operating shafts are disposed parallel to one another. Each of these shafts carry one of two similar interlocking disks which are disposed opposite one another in the same plane orthogonal to the axes of the manual operating shafts. The diameter of each interlocking disk is greater than the center line distance between the two manual operating shafts, and each disk includes a semicircular cutout portion whose shape closely conforms with the circular shape of the other interlocking disk when this semicircular cutout portion is facing the other interlocking disk. Thus, one of these manual operating shafts can only be rotated when the other manual operating shaft is positioned so that the semicircular cutout portion of the interlocking disk disposed on this other operating shaft is facing the shaft to be rotated. Similarly, when these shafts are disposed so that both of the semicircular cutout portions are adjacent, either manual operating shaft can be rotated, which rotation then prevents the subsequent rotation of the other manual operating shaft.

These two interlocking disks are disposed on their respective shafts so that when their corresponding semicircular cutout portions are adjacent, the interrupter manual operating handle is in its tripped position and the disconnect operating handle is in its closed position. This assures that the interrupter can only be closed when the disconnect is already closed, and the disconnect can only be closed when the interrupter is open.

Thus, the disconnect switch can never be operated to close or interrupt a live circuit.

In its tripped position, the axis of the pivotable connection of the interrupter movable contact rod and the bell crank coincide with the axis of rotation of the disconnect insulating support member. This arrangement assures that when the disconnect switch is opened, there is no movement of the interrupter movable contact rod relative to the interrupter fixed contact rod as the interrupter is rotated with the disconnect insulating support member on which it is disposed.

The interrupter operating mechanism includes a conventional toggle latch assembly connected between a lever arm of the interrupter operating shaft, which, in turn, is connected by a closing torsion spring to the interrupter manual operating shaft. When the interrupter is in its closed position, this toggle assembly is latched in its fully extended position, and holds the interrupter contacts closed against a force exerted by an opening torsion spring connected between the interrupter operating shaft and its supporting frame. When the toggle assembly is unlatched, it collapses and allows the opening spring to quickly open the interrupter. This latched toggle assembly can be independently released by standard overcurrent or undervoltage devices, or by operation of the manual interrupter operating handle, as described in more detail hereinafter.

These and other objects of the present invention will become more apparent from the following detailed description and from study of the appended drawings herein.

BRIEF DESCRIPTION OF THE DRAWINGS

FIG. 5 is a partial cross-sectional view of the interrupter operating mechanism, taken along the line 5—5 of FIG. 3, showing the detent members holding the interrupter mechanism, latch lever in its open position.

FIG. 6 is another partial cross-sectional view of the interrupter operating mechanism, similar to FIG. 5 except showing the detent members holding the latch lever in its closed position.

FIG. 7 is a perspective view of the interrupter trip lever assembly.

FIG. 8 is a partial perspective view of the under-voltage anti-closing device.

FIG. 9 is a partial perspective view of the interrupter manual trip device.

DESCRIPTION OF A PREFERRED EMBODIMENT

Figure 1:
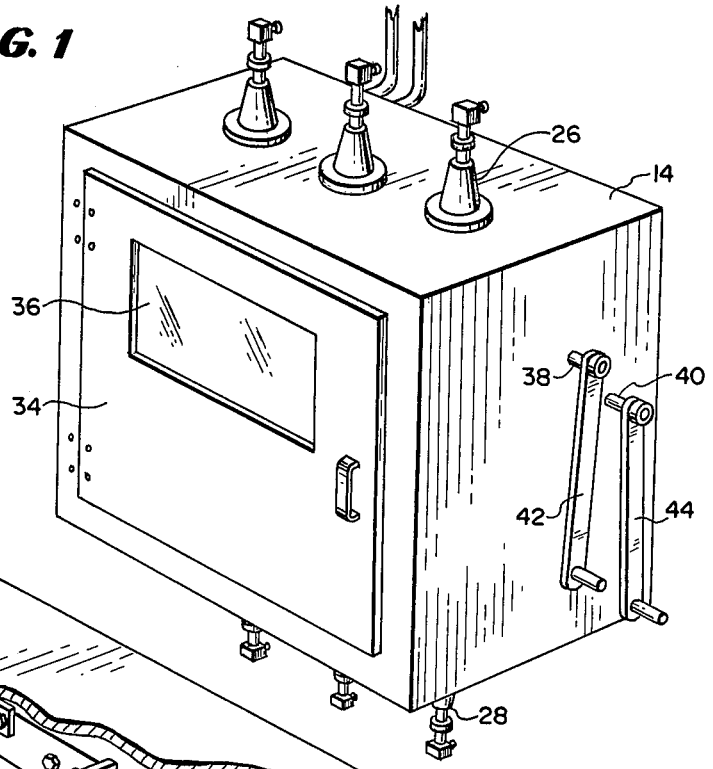
FIG. 1 is a perspective view of a three pole, enclosed, vacuum interrupter and disconnect switch combination, according to the invention.
Figure 2:
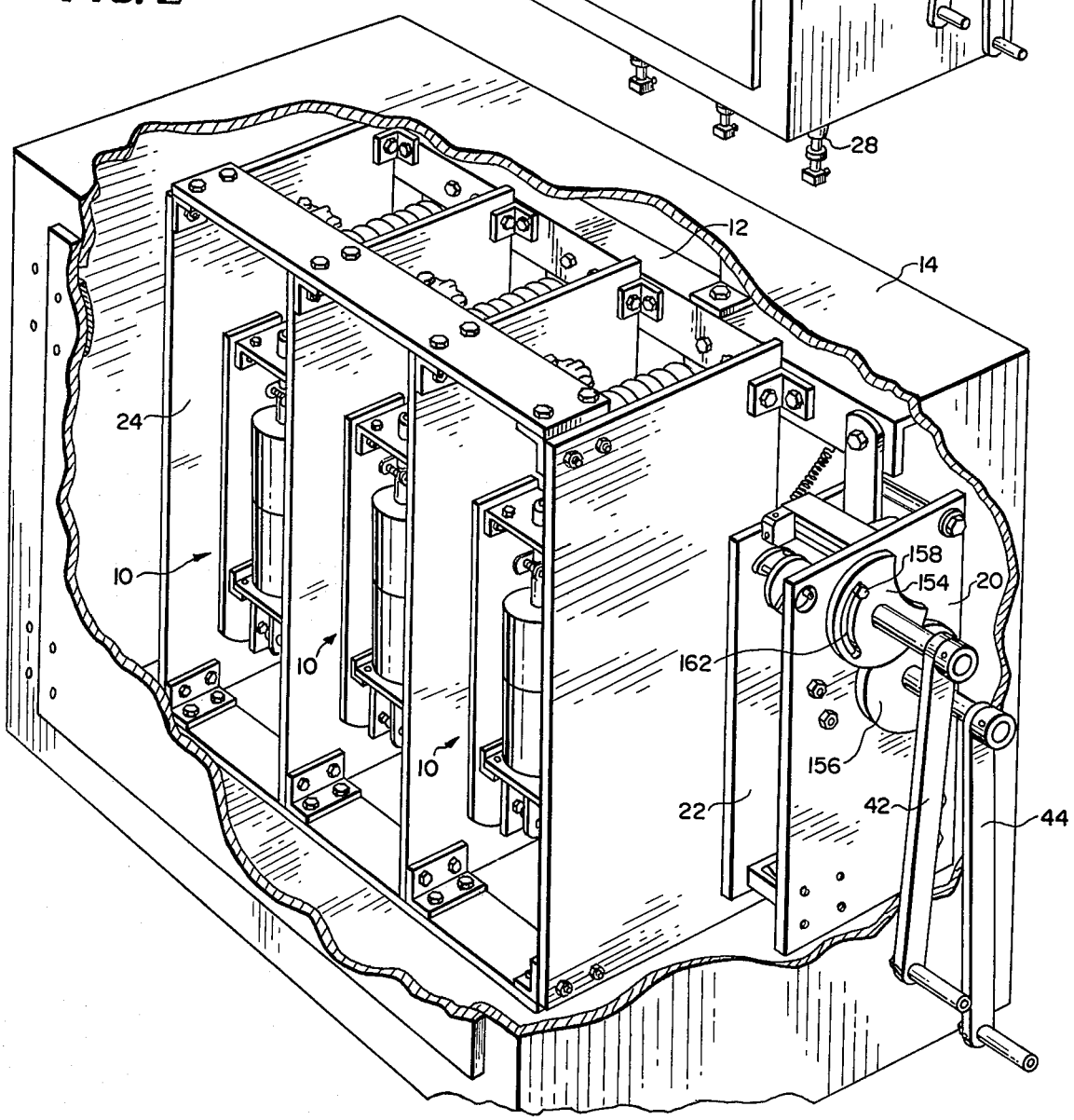
FIG. 2 is a perspective view of the embodiment of FIG. 1, with a portion of the housing removed, and the interrupter and disconnect switch both in their closed position.
Figure 3:
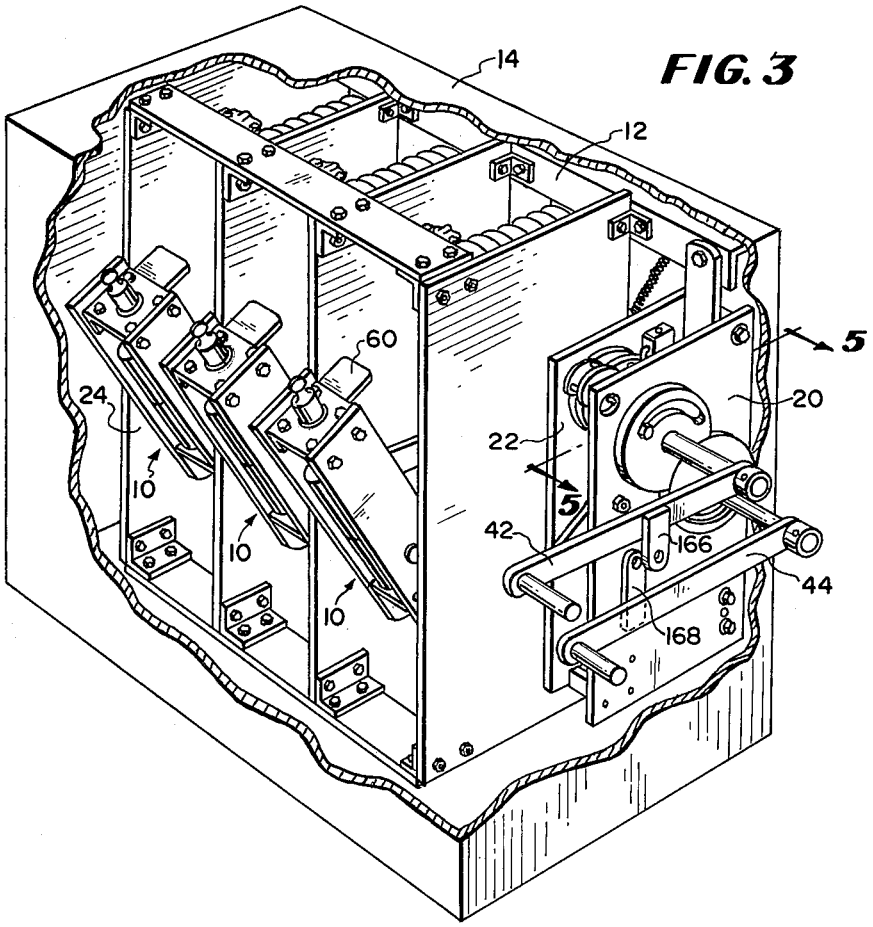
FIG. 3 is another cutaway, perspective view of the embodiment of FIG. 1, with the interrupter and disconnect switch both in their open position.

As illustrated in FIGS. 1–3, three single pole, vacuum interrupter and disconnect switch assemblies 10, mounted on a common support frame 12 within a housing 14, are gang-operated as a three pole vacuum interrupter and disconnect switch combination by common interrupter and disconnect operating mechanism 16, 18 carried by spaced-apart support plates 20, 22 of the frame 12. Insulating barrier plates 24, also mounted to the support frame 12, can be disposed between adjacent assemblies 10 and at both ends of the ganged assemblies 10 to minimize the line-to-line or line-to-ground spacing required for the required voltage impulse level of the combination switch.

The housing 14 includes line and load bushing terminals 26, 28 connected by suitable conductors (not shown) to respective line and load terminals 30, 32 of the single pole assemblies 10. The housing 14 also includes an access door 34 having a window 36 through which the open or closed position of the disconnect switches can be viewed.

The manual interrupter operating shaft 38 of the interrupter operating mechanism 16, and the manual disconnect operating shaft 40 of the disconnect operating mechanism 18 extend through a side of the housing 14 to respective, external interrupter and disconnect manual operating handles 42, 44.

Figure 4:
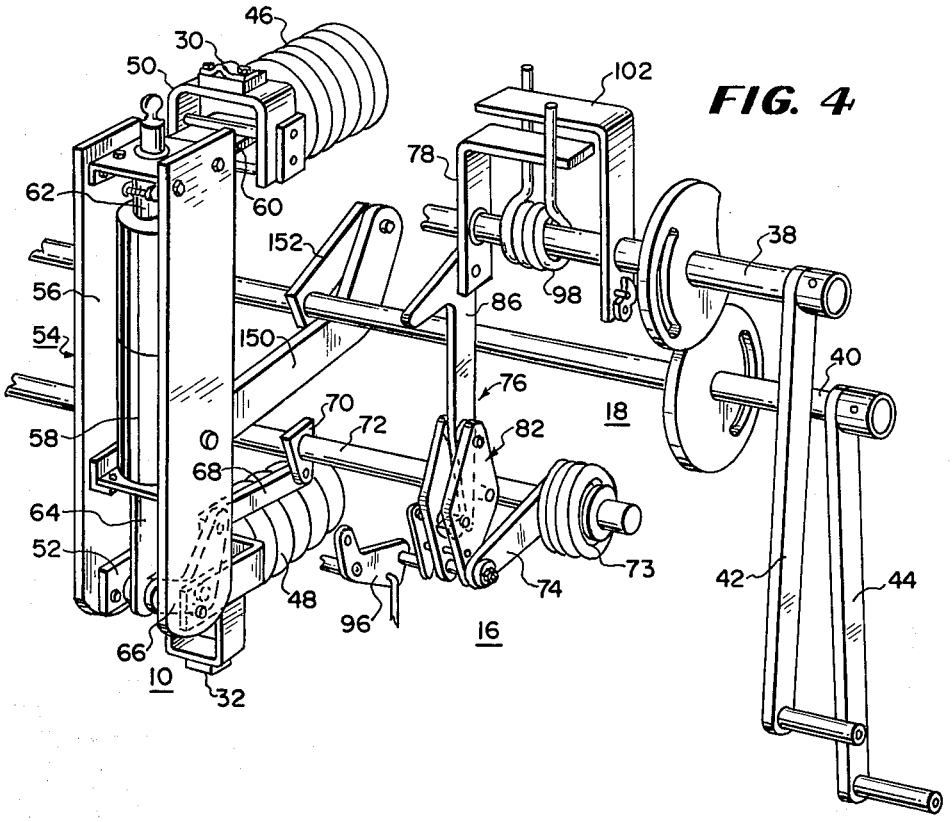
FIG. 4 is a perspective simplified view showing a single vacuum interrupter and disconnect switch combination assembly, and the main operating members of the interrupter and disconnect operating mechanisms.

As best shown in FIG. 4, each vacuum interrupter and disconnect switch assembly 10 includes two spaced apart electrical insulator support members 46, 48 each mounted at one end thereof to the support frame 12. The disconnect switch stationary contact assembly 50, which includes the line terminal 30, is mounted on the opposite end of the insulator 46. An electrically conductive bracket 52, which carries the load terminal 32, is mounted on the opposite end of the insulator 48.

A pivotable assembly 54 of the interrupter and disconnect assembly 10 includes two elongated insulating support plates 56 which are spaced apart for mounting therebetween a vacuum interrupter 58 and the movable contact 60 of the disconnect.

The disconnect moving contact 60 is affixed between the upper ends of the insulating support members 56, and the lower ends of the insulating support member 56 are pivotably connected to the bracket 52 for pivotal movement between a closed position of the disconnect wherein the disconnect moving contact 60 engages the disconnect stationary contact 50, and an opened position of the disconnect wherein the contacts 60, 50 are disengaged and suitably separated.

The vacuum interrupter 58 includes a stationary contact rod 62 which is affixed to the moving disconnect contact 60, and a movable contact rod 64 movable along the axis of the vacuum interrupter 58 between a closed position where it engages the stationary contact 62, and an open, or tripped, position where it is disengaged and separated by a suitable distance from the contact 62. The free end of the interrupter movable contact rod 64 is pivotably connected to one end of an electrically conductive bell crank 66 carried by the bracket 52. The interrupter 58 and bell crank 66 are disposed so that when the interrupter 58 is in its tripped position, the pivotable axis of the movable contact rod 64 about the bell crank 66 coincides with the pivotable axis of the support plates 56 about the bracket 52.

The other end of the bell crank 66 is pivotably connected to one end of an insulating connecting link 68, which has an opposite end pivotably connected to a crank arm 70 of the interrupter operating shaft 72 of the interrupter operating mechanism 16. An opening torsion spring 73, connected between the interrupter operating shaft 72 and the frame 12, exerts a force on the interrupter operating shaft 72 to maintain the interrupter in its open position.

The pivotal connection between the link 68 and the crank arm 70 can be made variable to compensate for erosion of the interrupter contacts 62, 64. For example, in a known "lost motion" arrangement, a pin affixed to the crank arm 70 and extending into a slotted end portion of the link 68, is properly positioned within the slot by a preloaded compression spring disposed between the end of the link 68 and the link pin, to thus assure adequate contact pressure between the interrupter contacts 62, 64 regardless of the wear of these contacts 62, 64. However, any such "lost motion" arrangement will not change the disposition of the bell crank 66 when the interrupter 58 is in its tripped or opened position.

A lever arm 74 of the interrupter operating shaft 72 is pivotably connected to one end of a conventional toggle latch mechanism 76, shown in its latched, fully extended position in FIG. 4. The opposite end of this toggle latch mechanism 76 is pivotably connected to a latchable end of an L-shaped latch lever 78, pivotably mounted on the interrupter manual operating shaft 38, which is latchable in either a closed or trip position as explained hereinafter.

The toggle latch mechanism 76 is similar to that described in U.S. Pat. No. 2,804,521 issued to A. Van Ryan et al., and includes a latching assembly 82 of two spaced apart plates 84 pivotably connected at one end to the lever arm 74. This latching assembly 82 is also shown, in more detail, in FIG. 7. At an opposite end of the latching assembly 82, a latch member 86 is pivotably connected at a medial portion between the two plates 84. One end of the latch member 86 is pivotably connected to the lever 78 so that if the lever 78 is rotated upward in a clockwise direction as seen from the right side in FIG. 4, the toggle latch assembly 76 is extended until the opposite end of the latch member 86 strikes against a spacing pin 88 connected between the plates 84, which prevents the toggle mechanism 76 from being completely extended to its toggle point position. The latching assembly 82 also includes a spring-loaded latch pin 90 pivotably held by the plates 84. The medial portion of this latch pin 90 between the plates 84 is shaped as a half-cylinder, and is spring held in such a position that the end of the latch member 86 will press against and rotate the flat surface of the half cylinder as it is moved toward its extended position.

After the end of the latch member 86 has traversed the latch pin 90, the latch pin 90 is spring-returned to its normal position, and the latch member 86 is held in its extended position by the cylindrical surface of the latch pin 90 until an unlatching lever 92 affixed to one end of the latch pin 90 is rotated to free the latch member 86. Then, if the latch lever 78 is latched in its closed position, the toggle mechanism 76 will be quickly collapsed and the interrupter tripped by the force exerted in it by the opening spring 73.

When the disconnect and interrupter are closed, the unlatching lever 92 of the toggle mechanism 76 is positioned adjacent a pin 94 of a trip lever 96 which is pivotally mounted to the support plate 22 of the frame 12. This trip lever 96 can be rotated to unlatch the toggle mechanism 76 by rotating the interrupter manual operating handle 42 clockwise, by the operation of an overcurrent relay, or by the operation of an undervoltage relay, as explained hereinafter with reference to FIG. 7.

An opposite end of the L-shaped latch lever 78 extends longitudinally along the interrupter manual operating shafts 38 between the two ends of a closing torsion spring 98 disposed about the shaft 38. An L-shaped driving member 102, affixed at one end to the shaft 38, has an opposite end which also extends longitudinally along the shaft 38 between the two ends of the closing spring 98, so that, when the latch lever 78 is not latched in a fixed position, rotational movement of the shaft 38 is transmitted to the latch lever 78 by the driving member 102 through the closing spring 98. The driving member 102 of the manual operating shaft 38 also includes a pivotable trip cam 104 whose rotation is limited by a pin 106. This cam 104 operates to trip the vacuum interrupter 58 when the interrupter manual operating handle is rotated from its close position toward its trip position, as explained hereinafter with reference to FIG. 7.

Referring now to FIG. 5, the latchable end of the latch lever 78 is shown latched in its open position by a detent member 108 which is pivotable about a pin 110 of the support plate 20 and includes a spring means for normally positioning the detent 108 in its latching position. However, the detent 108 is shaped so that as the latch lever 78 is rotated clockwise from its closed position to its open position, it will ride over the latching portion of the detent 108 by rotating it counterclockwise against its positioning spring. When the end of the latch lever 78 has cleared the latching portion of the detent 108, the detent 108 will be spring-returned to its latching position, and will hold the latch lever 78 in its open position until the detent 108 is rotated counterclockwise to release it.

A detent release lever 112, pivoted about a pin 114 affixed to the free end of the detent member 108 is spring-loaded to position a raised portion, or spur, of the lever 112 in the path of the driving member 102 of the manual operating shaft 38 as the manual operating handle 42 is rotated from its open position to its closed position. When the driving member 102 contacts the spur of the release lever 112 near the end of its path of travel from its open position to its closed position, the release lever 112 is pushed against the end of the detent member 108 to rotate the detent 108 counterclockwise about its pivot pin 110 and release the latch lever 78, as shown by dashed lines in FIG. 5.

As the manual operating handle 42 is moved from its open position to its closed position, the closing spring 98 is charged, since one end of this spring is rotated with the driving member 102 of the manual operating shaft 38 and the other end of the closing spring 98 is held stationary by the latch lever 78. Then when the driving member 102 strikes the release lever 112 and unlatches the latch lever 78, the fully-charged closing spring 98 quickly rotates the latch lever 78 to its closed position. Referring again to FIG. 4, the toggle mechanism 76, which had been fully extended and latched by the previous of the manual operating handle to its open position, is acted upon by the latch lever 78 to quickly close the vacuum interrupter 58, and, at the same time, to charge the opening spring 73 for the next opening operation.

When the latch lever 78 is released from its latched open position as the manual operating handle 42 is rotated to its closed position, it is quickly rotated counterclockwise, as seen in FIG. 6, and its end slides over another detent member 116, similar to the detent 108, which is pivotable about a pin 118 of the support plate 20, and includes a spring means for normally positioning the detent member 116 in its latching position. After the latch lever 78 reaches its closed position, it is held in this position until the detent 116 is rotated clockwise about its pivot pin 118 to release the latch lever 78.

A detent releasing link 120 is pivotable at one end about a pin 122 disposed at the free end of the detent member 116. The opposite end of the link 120 defines a slot 124, into which a pin 126 extends. This pin 126 is affixed to the lever arm 74 of the interrupter operating shaft 72, so that, when the interrupter is tripped by unlatching the toggle mechanism 76, the detent member 116 will be rotated clockwise by the link 120 to release the latch lever 78 so that it can be subsequently reset for a reclosing operation.

Both the pin 114 of the detent 108 and the pin 122 of the detent 116 extend into adjacent openings in the support plate 20, to thereby limit the travel of the detents 108, 116. Consequently, the end of the link 120 is slotted rather than directly pivoted about the pin 126 to limit the travel of the link 120 to that of the pin 122 within the opening of the support plate 20.

As best seen in FIG. 7, the trip lever 96 is pivotable about a pin 128 affixed to the support plate 22 of the frame 12. An undervoltage trip lever 130 is also pivotable about the pin 128. One end of the undervoltage trip lever 130 is pivotably attached to a link 132, which in turn is attached to the armature of an undervoltage relay 133, which exerts a force on the lever 130 proportional to the voltage impressed on the relay 133 to rotate the lever counterclockwise, against a counterforce exerted on the lever 130 by a spring 134 attached between the same end of the lever 130 and the support frame. When the voltage impressed on the undervoltage relay 133 drops below a predetermined value, the spring 134 will cause the undervoltage trip lever 130 to rotate clockwise about the pin 128, and a pin 136 affixed to the undervoltage trip lever 130 will strike against, and rotate clockwise, the trip lever 96. In turn, this causes the trip pin 94 of the trip lever 96 to rotate the unlatching lever 92 of the toggle mechanism 76, which unlatches the toggle mechanism 76 and allows the charged opening spring 73 to trip the vacuum interrupter 58.

Also a rod 138, pivotally attached to a pin 139 of the undervoltage trip lever 130 at one end, as shown in FIG. 7, and adjacent the detent release lever 112 of the detent member 108, shown in FIG. 8, prevents the vacuum interrupter from being manually closed as long as an undervoltage condition exists, by pressing against the release lever 112 and rotating it clockwise about its pivot pin 114, so that the driving member 102 of the manual operating shaft 38 will not strike against the spur of the release lever 112 to unlatch the latch lever 78 and allow the closing spring 94 to close the interrupter 58.

Another connecting link 140 is pivotably attached to the trip lever 96 at one end, as shown in FIG. 7, and to the armature of an overcurrent relay (not shown) at an opposite end. When an overcurrent condition exists, the overcurrent relay armature exerts a force on this connecting line 140 to rotate the trip lever 96 clockwise about its pivot pin 128 and trip the interrupter 58.

A pin 142, affixed to an opposite end of the trip lever 96, is disposed within a slot 144 at one end of a link 146. A pin 148 affixed to the opposite end of the link 146, as shown in FIG. 9, extends into an opening in the support plate 22 which serves to limit the travel of the link 146. Spring means connected between the pin 148 and the support plate 22 normally positions the link 146 in its non-tripping position. When the driving member 102 of the manual operating shaft 38 is rotated from its normal trip position to its closed position, the trip cam 104 will be rotated about its pivot and traverse the pin 148 without moving this pin 148. However, when the driving member 102 is rotated in the reverse direction from its closed position to its trip position, the pin 106 prevents the trip cam 104 from rolling around and over the pin 148, and the cam 104 exerts a force against the pin 148 to move the link 146 against the pin 142 of the trip lever 96, and rotate the trip lever 96 in a clockwise direction to trip the interrupter 58.

Referring again to FIG. 4, the pivotable assembly 54 is connected to the disconnect operating mechanism 18 by an insulating connecting link 150, which is pivotably connected to a medial portion of one of the insulating support plates 56 at one end, and pivotably connected to a crank arm 152 of the manual disconnect shaft 40 at an opposite end. After the interrupter 58 has been tripped, rotation of the manual disconnect operating handle 44 in a clockwise direction causes the pivotable assembly 54 to rotate about its pivot axis in a counterclockwise direction, disengaging and separating the disconnect stationary and movable contacts 50, 60.

Since the disconnect operating mechanism 18 is independent of the interrupter operating mechanism 16, a positive interlock between the two mechanisms 16, 18 is required to assure that the disconnect can only be opened or closed when the interrupter is open. As shown in FIG. 2, this interlock includes two similar interlocking disks 154, 156 mounted respectively on the manual interrupter operating shaft 38 and the manual disconnect operating shaft 40 in the same plane orthogonal to the axes of these shafts 38, 40. The diameter of each interlocking disk 154, 156 is greater than the centerline distance between the two shafts 38, 40 and each disk 154, 156 are orientated on their respective shafts 38, 40 such that when the interrupter manual operating handle 42 is in its tripped position, and the disconnect manual operating handle 44 is in its closed position, the semicircular indents of the two disks 154, 156 face one another and symmetrically intersect the plane extending between the axes of the shafts 38, 40. With such an orientation of the disks 154, 156, the disconnect operating mechanism 18 can only be operated when the interrupter 58 has been tripped and the interrupter manual operating handle 42 is in its tripped position, and the disconnect must be closed before the interrupter 58 can be closed. This assures that the disconnect contacts 50, 60 never interrupt or close an energized circuit.

Figure 11:
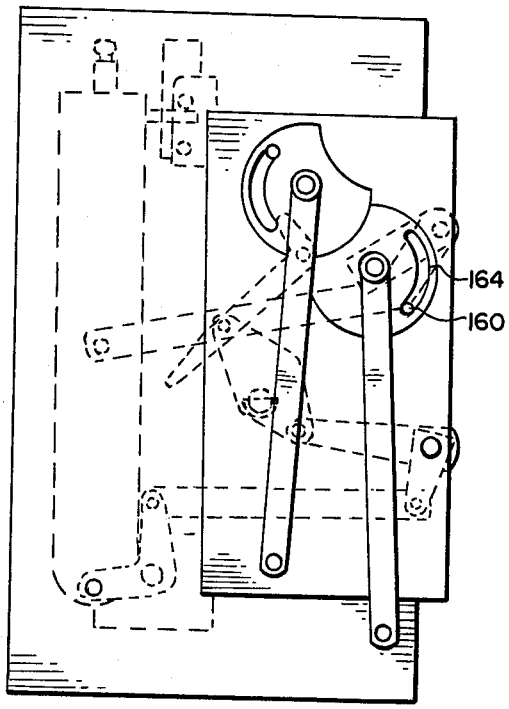
FIGS. 10–13 are sequential simplified side views of a vacuum interrupter and disconnect combination, illustrating the relative position of the main elements of the disconnect and interrupter operating mechanisms, when both the interrupter and disconnect are closed, when the interrupter has been tripped electrically, when the interrupter manual operating handle has been rotated to its open position, and when the disconnect manual operating handle has also been rotated to its open position.

Each of these interlocking disks 154, 156 can be used in cooperation with respective positioning members 158, 160 affixed to the support plate 20 adjacent these disks 154, 156, to limit the travel of their respective manual operating shafts 38, 40 and define their opened and closed positions. As shown in FIG. 2, the interlocking disk 154 includes an arcuate slot 162 therein, through which extends a bolt or pin 158 fastened to the support plate 20, which effectively limits the rotational movement of the interrupter manual operating shaft 38. The disk 156 includes a similar arcuate slot 164, through which a positioning bolt or pin 160 of the support plate 20 extends, as shown in FIG. 11.

Since the open position of the manual operating handles 42, 44 are fixed positions determined by the positioning pins 158, 160, these handles 42, 44 can include provisions for padlocking these handles 42, 44 in their open position, such as the handle extensions 166, 168 of the respective handles 42, 44, shown in FIG. 3, each of which includes holes therethrough which are aligned so that the two extensions 166, 168 can be padlocked together only when both operating handles 42, 44 are in their open position.

Figure 10:
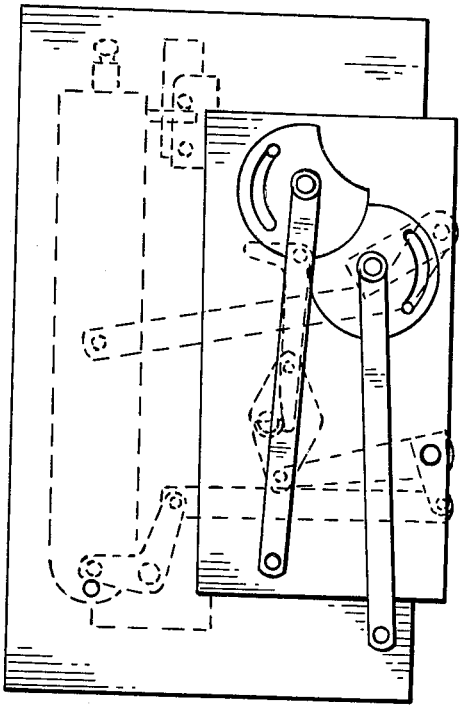

When both the disconnect assembly 54 and the vacuum interrupter 58 are closed, as shown in FIG. 10, the latch lever 78 of the interrupter operating mechanism 16 is held in its closed position by the detent 116, the force of the fully charged opening spring 73 is impressed on the latched, fully-extended, toggle mechanism 76, the toggle latch release lever 92 is positioned for tripping by the trip lever 96, the pivotal axis of the interrupter 58 is spaced from the pivotal axis of the disconnect assembly 54, and the disconnect operating mechanism 18 is held in its closed position by the interlock disks 154, 156.

If then the overcurrent or undervoltage relays act upon the trip lever 96 to release the toggle latch 90, the fully charged opening spring 73 will quickly collapse the toggle mechanism 76 and trip the interrupter 58. When the interrupter 58 is tripped, the detent 116 is rotated by the link 120 connected to the lever arm 74 of the interrupter operating shaft 72, to free the latch lever 78 so that it can subsequently be rotated to its open position. As shown in FIG. 11, the pivotal axis of the interrupter 58 now coincides with the pivotable axis of the disconnect assembly 54.

If the interrupter 58 is manually tripped, rather than automatically tripped by the overcurrent or undervoltage relays, the trip cam 104 will act on the trip lever 96 to unlatch the toggle mechanism 76 when the interrupter manual operating handle 42 has been rotated only a few degrees from its closed position, so that, immediately after the interrupter has been manually tripped, the positions of the various members of the interrupter operating mechanism 16 will approximate those shown in FIG. 11, with the manual operating handle 42 rotated a few degrees toward its open position.

Figure 12:
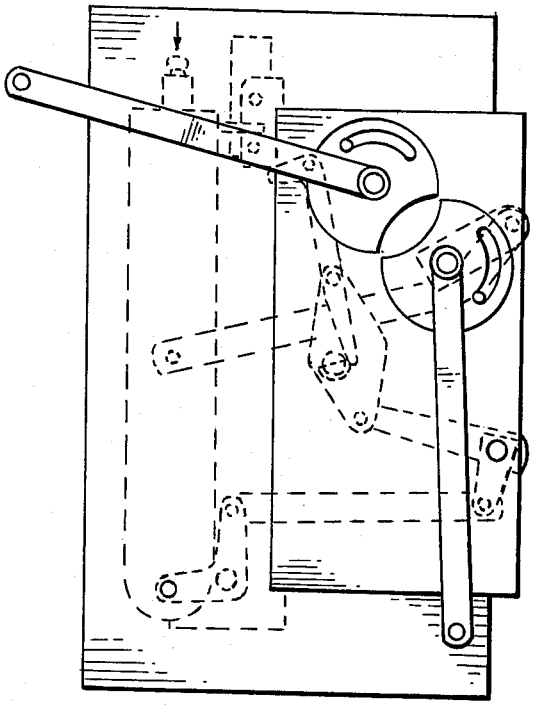

If the interrupter manual operating handle 42 is now rotated to its open position, as shown in FIG. 12, the toggle mechanism 76 is again fully extended and latched, the latch lever 78 is rotated to its open position and held in that position by the detent 108, and the interlocking disks 154, 156 are positioned so that either the disconnect 54 can be opened by rotating the disconnect operating handle 44 clockwise to its open position, or the interrupter 58 can be reclosed by rotating the interrupter operating handle 42 counterclockwise to its closed position.

Figure 13:
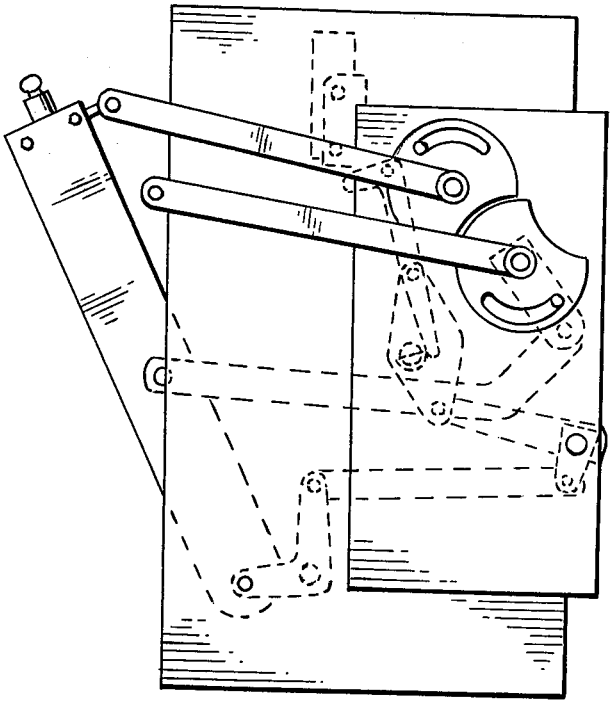

If next the disconnect operating handle is turned to its open position, the disconnect 54 and the interrupter 58 will be rotated about their common pivotal axis to the open position of the disconnect, as shown in FIG. 13. None of the elements of the interrupter operating mechanism 16 is moved or changed when the disconnect 54 is opened. However, the interlocking disks 154, 156 are now positioned to hold the interrupter manual operating handle 42 in its open position.

After the disconnect operating handle 44 has been returned to its closed position and the disconnect 54 reclosed, as seen in FIG. 12, the interrupter manual operating handle 42 can be rotated counterclockwise to its closed position, and the interrupter 58 again closed, as seen in FIG. 10, assuming no undervoltage condition exists.

As the interrupter manual operating handle 42 is rotated from its open position towards its closed position, the latch lever 78 continues to be held in its open position by the detent 108 until the closing spring 98 is fully charged and the driving member 102 rotates the detent 108 about its pivot pin 110 to release the latch lever 78. When the latch lever 78 is released, it is quickly rotated by the fully charged closing spring 98 to its closed position, closing the interrupter 58 and charging the opening spring 73 for a subsequent opening operation. After being rotated to its closed position, the latch lever 78 is held in that position by the detent 116.

While only a manual operating mechanism 18 for the interrupter 58 has been described herein, the invention is not limited to this. For example, a spring bias means connected between the manual operating shaft 38 and the frame 12 can be used to rotate the interrupter manual operating handle 42 to its open position after the interrupter 58 has been tripped by the overcurrent or undervoltage relays, to provide visual indication that the interrupter 58 is open, and reset the toggle mechanism 76 in its latched position for a subsequent closing operation.

In addition to this spring bias means, a remotely-controlled motor drive, which is electrically interlocked with the operating mechanism 16, 18 by conventional auxiliary contact devices, can be used to reclose the interrupter 58 by rotating the interrupter operating shaft 38 to its close position. The auxiliary contact devices, operated respectively by the disconnect operating mechanism 18 and the interrupter operating shaft 72, can be connected in the motor drive circuit to allow actuation of this motor drive only when the disconnect pivotable member 54 is in its fully closed position, and the interrupter 58 is in its fully opened position.

Also, a conventional reclosing circuit or relay can be used with such a closing motor drive to reclose the interrupter 58 a predetermined number of times before lockout when the interrupter 58 is tripped by the overcurrent relay. However, when such a reclosing relay is used, means for disenabling the reclosing circuit should be disposed at the combination interrupter and switch, so that the interrupter can be manually tripped without automatically reclosing.

Also, while the two interlocking disks 154, 156 are shown in the drawings as being identical in size, it is obvious that these disks 154, 156 can vary greatly in size, so long as the sum of their respective radii is greater than the centerline distance between the operating shafts 38, 40.

What is claimed is:

1. In a circuit interrupter and visible break disconnect combination which includes support means, an interrupter operating means mounted on the support means, and a disconnect operating means mounted on the support means, at least one switching assembly comprising:

first and second spaced apart electrical insulator support members, affixed to the support means;

a first electrically conductive terminal member affixed to one end of the first insulator support member;

a second electrically conductive terminal member affixed to one end of the second insulator support member;

an elongated, electrically insulative disconnect support member, pivotably mounted at one end thereof to the second terminal member for rotation about an axis of the second terminal member between a close and an open position;

a third electrically conductive terminal member, affixed to an opposite end of the disconnect support member, which is engaged with the first terminal member when the disconnect support member is in its close position, and is disengaged and spaced from the first terminal member when the disconnect support member is in its open position;

an insulative disconnect connecting link means, having one end pivotably attached to a median portion of the disconnect support member and another end attached to the disconnect operating means, for connecting the disconnect support member for pivotal movement by the disconnect operating means, between the open and close positions of the disconnect support member corresponding to respective open and close positions of the disconnect operating means;

a circuit interrupter carried by the disconnect support member and comprising a first electrically conductive interrupting contact member affixed to the third terminal member, and a second electrically conductive interrupting contact member which is movable relative to the first interrupting contact member between a closed position at which the second interrupting contact member engages the first interrupting contact member, and a tripped position at which the second interrupting contact member is disengaged and spaced from the first interrupting contact member;

an electrically conductive bell crank pivotably mounted to the second terminal member, for rotation between a closed and a tripped position, said bell crank having one of its two arms pivotably connected to the second interrupting contact member so that the closed and tripped positions of the second interrupting contact member corresponds respectively to the closed and tripped position of the bell crank, and the pivotal axis of the second interrupting contact member about the bell crank arm coincides with the pivotal axis of the disconnect support member about the second terminal member when the bell crank is disposed in its tripped position;

an insulative interrupter connecting link means having one end pivotably attached to the other arm of the bell crank and another end attached to the interrupter operating means, for connecting the bell crank for rotation by the interrupter operating means between the tripped and closed positions of the bell crank, corresponding to respective tripped and closed positions of the interrupter operating means.

2. An interrupter and disconnect combination, as described in claim 1, which further comprises:

first interlock means for allowing the operation of the disconnect operating means only when the interrupter operating means is in the tripped position; and second interlock means for allowing the operation of the interrupter operating means only when the disconnect operating means is in the close position.

3. An interrupter and disconnect combination, as described in claim 2, wherein the interrupter operating means includes overcurrent tripping means.

4. An interrupter and disconnect combination, as described in claim 2, wherein the interrupter operating means includes undervoltage tripping means.

5. An interrupter, as described in claim 2, which further includes disenabling means for preventing rotation of said bell crank from the tripped position to the closed position of same during the occurrence of a low voltage line condition.

6. An interrupter, as described in claim 2, wherein the interrupter operating means is a quick make, quick break, interrupter operating mechanism which includes:

a first operating shaft, having a longitudinal axis, which is rotatably mounted to the support means for rotation about its longitudinal axis between a closed and a tripped position;

at least one crank arm affixed to the first shaft, having an end pivotably connected to a corresponding insulative interrupter connecting link means;

opening spring means for biasing the first shaft toward its tripped position;

an operating lever affixed to the first shaft;

a second shaft, having a longitudinal axis, which is rotatably mounted to the support means for rotation about the second shaft axis between a close and an open position;

a latch lever, rotatably mounted for rotation about the second shaft axis between a close and an open position;

closing spring means, connected between the latch lever and the second shaft, for biasing the latch lever toward a corresponding position of the second shaft;

first releasable latching means for holding the latch lever in its open position as the second shaft is rotated from the open position towards the close position thereof, against the bias force of the closing spring means;

first latch release means for releasing the first latching means as the second shaft is rotated towards the close position thereof, at an intermediate position of the second shaft at which the closing spring means is fully charged;

second releasable latching means for holding the latch lever in its close position when the first shaft is in the closed position;

second latch release means for releasing the second latching means when the first shaft is rotated from the closed position toward the tripped position thereof;

a collapsible toggle linkage assembly which includes a first elongated member, a second elongated member pivotably connected to the first member for rotation about the first member between an extended position and a retracted, or collapsed, position of the linkage assembly, and a releasable trip latch means for holding the first and second members in the extended position, one end of the first member being pivotably connected to the operating lever affixed to the first shaft and an opposite end of the second member being pivotably connected to the latch lever, such that when the latch lever is in the open position, the linkage assembly is in its extended latched position and the first shaft is in its tripped position, and when the latch lever is in the close position and the linkage assembly in its extended latched position, the first shaft is in its closed position; and trip latch releasing means for unlatching the linkage assembly only when the first shaft is in its closed position, said trip latch releasing means being actuated by the rotation of the first shaft from its close position toward its open position.

7. An interrupter, as described in claim 6, which further comprises overcurrent sensing means for actuating the trip latch releasing means upon the occurrence of an overcurrent line condition.

8. An interrupter, as described in claim 6, which further comprises undervoltage sensing means for actuating the trip latch releasing means upon the loss of line voltage or the occurrence of a low voltage line condition.

9. An interrupter, as described in claim 6, which further comprises means, responsive to the undervoltage sensing means, for rendering inoperative the first latch release means upon loss of line voltage or the occurrence of a low voltage line condition.

10. An interrupter, as described in claim 6, wherein the disconnect operating means comprises:

a disconnect operating shaft, having a longitudinal axis, which is rotatably mounted to the support means for rotation about its longitudinal axis between a close and an open position, in spaced, parallel arrangement with the second shaft of the interrupter operating mechanism; and at least one crank lever affixed to the disconnect operating shaft, having an end pivotably connected to a corresponding disconnect connecting link means.

11. An interrupter, as described in claim 10, wherein said first and second interlock means comprise:

a first and a second interlocking disk, carried respectively by the disconnect operating shaft and the second shaft of the interrupter operating mechanism, and disposed opposite one another in a plane orthogonal to the axes of rotation of the disconnect operating shaft and the second shaft, the sum of the radii of the two disks being greater than a centerline distance between the disconnect operating shaft and the second shaft, each disk defining a semicircular recessed portion of its periphery whose shape closely conforms with the circular shape of the other interlocking disk when said semicircular recessed portion is facing the other disk, the first disk being disposed on the disconnect operating shaft so that the semicircular recessed portion of its periphery faces the second disk only when the disconnect operating shaft is in the close position, and the second disk being disposed in the second shaft so that the semicircular recessed portion of its periphery faces the first disk only when the second shaft is in its open position.

12. An interrupter, as described in claim 11, which further comprises:

a manual interrupter operating handle affixed to the second shaft of the interrupter operating mechanism;

a manual disconnect operating handle affixed to the disconnect operating shaft; and means for padlocking the manual disconnect operating handle in the open position of the disconnect operating shaft.

* * * * *